US007662535B2

(12) United States Patent
Yang et al.

(10) Patent No.: US 7,662,535 B2
(45) Date of Patent: Feb. 16, 2010

(54) TONER PARTICLES OF CONTROLLED MORPHOLOGY

(75) Inventors: Xiqiang Yang, Webster, NY (US); Sandra G. Taft, Rochester, NY (US); Mridula Nair, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 408 days.

(21) Appl. No.: 11/611,208

(22) Filed: Dec. 15, 2006

(65) Prior Publication Data

US 2008/0145779 A1 Jun. 19, 2008

(51) Int. Cl.
*G03G 5/00* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS

| | | | | |
|---|---|---|---|---|
| 4,833,060 | A | 5/1989 | Nair et al. | |
| 4,965,131 | A | 10/1990 | Nair et al. | |
| 5,283,151 | A | 2/1994 | Santilli | |
| 6,207,338 | B1 | 3/2001 | Ezenylimba et al. | |
| 6,294,595 | B1 | 9/2001 | Tyagi et al. | |
| 6,380,297 | B1 | 4/2002 | Zion et al. | |
| 7,041,420 | B2 | 5/2006 | Vandewinckel et al. | |
| 2003/0165767 | A1 * | 9/2003 | Patel et al. | 430/137.14 |
| 2007/0031748 | A1 | 2/2007 | Kotsugai et al. | |
| 2008/0145780 | A1 | 6/2008 | Yang et al. | |

FOREIGN PATENT DOCUMENTS

| | | |
|---|---|---|
| EP | 1 280 011 | 1/2003 |

* cited by examiner

*Primary Examiner*—Mark A Chapman
(74) *Attorney, Agent, or Firm*—Carl F. Ruoff; Andrew J. Anderson

(57) ABSTRACT

The present invention is a method for the preparation of electrostatographic toner that includes the following steps. A polymer material is dissolved in an organic solvent to form an organic phase that includes a metal complex of zinc dimethyldithiocarbamate; zinc diethyldithiocarbamate; dibenzyldithiocarbamate, zinc di-n-butyldithiocarbamate. The organic phase is dispersed in an aqueous phase that includes a particulate stabilizer to form a dispersion and the resultant dispersion is homogenized. The organic solvent is evaporated and the resultant product is recovered, washed and dried.

14 Claims, 2 Drawing Sheets

TONER PARTICLES OF CONTROLLED MORPHOLOGY

CROSS-REFERENCE TO RELATED APPLICATIONS

This application relates to commonly assigned U.S. Ser. No. 11/611,226 (Publication No. 2008/0145780) entitled "TONER PARTICLES OF CONTROLLED MORPHOLOGY" filed simultaneously herewith and hereby incorporated by reference for all that it discloses.

FIELD OF THE INVENTION

This invention relates to a method for the preparation of polymeric powders suitable for use as electrostatographic toner, and more particularly, to a method for the preparation of toner particles of controlled shape in which certain organometallic complexes are employed for controlling morphology of the toner particles.

BACKGROUND OF THE INVENTION

Electrostatic toner polymer particles can be prepared by a process frequently referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al.

U.S. Pat. No. 5,283,151 is representative of earlier work in this field and describes the use of carnauba wax to achieve similar toner morphology. The method comprises the steps of dissolving carnauba wax in ethyl acetate heated to a temperature of at least 75° C. and cooling the solution, so resulting in the precipitation of the wax in the form of very fine needles a few microns in length; recovering the wax needles and mixing them with a polymer material, a solvent and optionally a pigment and a charge control agent to form an organic phase; dispersing the organic phase in an aqueous phase comprising a particulate stabilizer and homogenizing the mixture; evaporating the solvent and washing and drying the resultant product.

Unfortunately, this technique requires the use of elevated temperature to dissolve the wax in the solvent and cooling the solution to precipitate the wax. The wax does not stay in solution of ethyl acetate at ambient temperature and as a result it is very difficult to scale up using this methodology.

The shapes of the toner particles have a bearing on the electrostatic toner transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toner particles by means other than the choice of pigment, binder, or charge agent. The shape of the toner particles is modified to enhance the cleaning and transfer properties of the toner.

SUMMARY OF THE INVENTION

The present invention is a method for the preparation of electrostatographic toner that includes the following steps. A polymer material is dissolved in an organic solvent to form an organic phase that includes a metal complex of zinc dimethyldithiocarbamate; zinc diethyldithiocarbamate; dibenzyldithiocarbamate, zinc di-n-butyldithiocarbamate. The organic phase is dispersed in an aqueous phase that includes a particulate stabilizer to form a dispersion and the resultant dispersion is homogenized. The organic solvent is evaporated and the resultant product is recovered, washed and dried.

Figure 1:
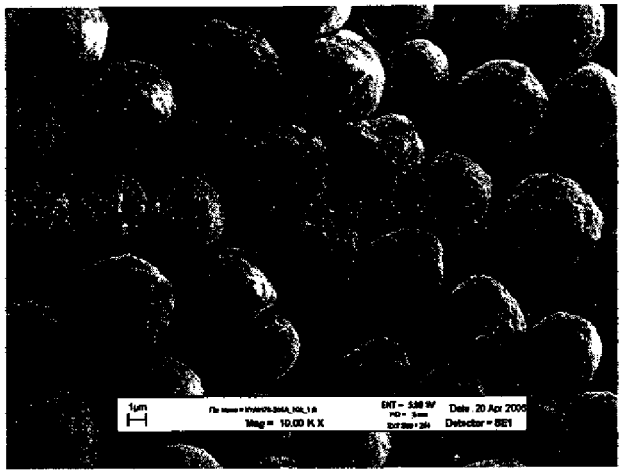
FIG. 1 is an SEM image of toner particles from Example 3.

For a better understanding of the present invention, together with other advantages and capabilities thereof, reference is made to the following detailed description in connection with the above-described drawings.

DETAILED DESCRIPTION OF THE INVENTION

In accordance with the present invention, a pigment dispersion is prepared by conventional techniques as, for example, by media milling, melt dispersion and the like. The pigment dispersion, polymer material, a solvent, a metal complex and, optionally, a charge control agent are combined to form an organic phase in which the pigment concentration ranges from about 4% to 20%, by weight, based upon the total weight of solids. The charge control agent is employed in an amount ranging from 0 to 10 parts per hundred by weight, based on the total weight of solids, with a preferred range from 0.2 to 3.0 parts per hundred. This mixture is permitted to stir overnight and then dispersed in an aqueous phase comprising a particulate stabilizer and, optionally, a promoter.

The metal complexes suitable for use as toner shape control additives are zinc-sulfur ligand containing complexes, such as zinc dimethyldithiocarbamate, dibutyldithiocarbamate, dibenzyldithiocarbamate, and diethyldithiocarbamate. The shape control agent is generally added directly into the oil phase and is employed in an amount ranging from 0.1 to 2 parts per hundred by weight, based on the total weight of solids, with a preferred range of 0.4 to 2 parts per hundred.

The solvents chosen for use in the organic phase steps may be selected from among any of the well-known solvents capable of dissolving polymers. Typical of the solvents chosen for this purpose are chloroform, dichloromethane, ethyl acetate, vinyl chloride, methyl ethyl ketone, and the like.

The particulate stabilizer selected for use herein may be selected from among highly cross-linked polymeric latex materials of the type described in U.S. Pat. No. 4,965,131 to Nair et al., or silicon dioxide. Silicon dioxide is preferred. It is generally used in an amount ranging from 1 to 15 parts by weight based on 100 parts by weight of the total solids of the toner employed. The size and concentration of these stabilizers control and predetermine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxymethylcellulose, tetramethyl ammonium hydroxide or chloride, diethylaminoethyl methacrylate, water soluble complex resinous amine condensation products of ethylene oxide, urea and formaldehyde and polyethyleneimine. Also, effective for this purpose are gelatin, casein, albumin, gluten and the like or non-ionic materials such as methoxycellulose. The promoter is generally used in an amount from about 0.2 to about 0.6 parts per 100 parts, by weight, of aqueous solution.

Various additives generally present in electrostatograhic toner may be added to the polymer prior to dissolution in the solvent or in the dissolution step itself, such as charge control agents, waxes and lubricants. Suitable charge control agents are disclosed, for example, in U.S. Pat. Nos. 3,893,935 and 4,323,634 to Jadwin et al. and U.S. Pat. No. 4,079,014 to Burness et al., and British Patent No. 1,420,839 to Eastman Kodak. Charge control agents are generally employed in small quantities such as from about 0.01 to 10 parts per hundred by weight based upon the weight of the total solids content (weight of the toner) and preferably from about 0.2 to about 3.0 parts per hundred.

The resultant mixture is then subjected to mixing and homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase by volume may range from 1:1 to approximately 9:1. This indicates that the organic phase is typically present in an amount from about 10% to 50% of the total homogenized volume.

Following the homogenization treatment, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins; polytetrafluoroethylene and polytrifluorochloroethylene; polyamides, such as poly(hexamethylene adipamide), poly(hexamethylene sebacamide), and polycaprolactam: acrylic resins, such as poly(methyl methacrylate), poly(methyl acrylate), poly(ethyl methacrylate) and poly(styrene-methyl methacrylate); ethylene-methyl acrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as $TiO_2$, car-boil black and the like. Typical of the phthalocyanine pigments are copper phthalocyanine, a monochlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118, azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to give a content thereof in the toner from about 1% to 40%, by weight, based upon the weight of the toner, and preferably within the range of 4% to 20%, by weight.

EXAMPLE 1

Preparation of Wax Dispersion

To a glass jar containing a mixture of wax and dispersant in ethyl acetate were added zirconia beads (diameter about 1.2 mm). The container was then placed on a (Sweco) powder grinder and the wax milled for one to three days. Afterwards, the beads were removed by filtration through a screen and the resulting solid particle dispersion was used for toner preparation as follows.

Disp A.Polywax 500 (T-60 grade) (Baker Petrolite), 20.0 g
Tuftec P2000 (AK Elastomer), 3.0 g
Ethyl Acetate, 77.0 g
Zirconia Beads, 1.2 mm, 100 mL
Determined solid content of recovered dispersion: 17.4%

EXAMPLE 2

Comparative

An organic phase dispersion was prepared using 89.08 g of ethyl acetate. 19.78 g of Kao Binder E (Kao Specialties Americas LLC), 2.919 g of BASF Lupreton Blue SE 1163, and 13.22 g of the above wax dispersion A. The mixture was stirred overnight with a magnetic stirrer. This organic phase is mixed with an aqueous mixture prepared with 172.93 g of water, 1.1475 g of potassium hydrogen phthalate (KHP), 11.00 g of Nalco™ 1060 and 2.42 g of 10% promoter (poly (adipic acid-comethylaminoethanol)). This mixture was then subjected to very high shear using a Silverson L4R Mixer (sold by Silverson Machines, Inc.) followed by a Microfluidizer. Upon exiting, the solvent was removed from the particles so formed by rotary evaporator under reduced pressure. These particles were collected and washed with water. After drying, the resulting particles had a volume-averaged size of 6.03 μm and entirely spherical.

EXAMPLE 3

A dispersion was prepared using 73.45 g of ethyl acetate, 16.25 g of Kao Binder E 2.335 g of BASF Lupreton Blue SE 1163, 0.040 g of Compound 1 (zinc dimethyldithiocarbamate, SCA-1), and 7.93 g of the above wax dispersion A. The mixture was stirred overnight with a magnetic stirrer. This mixture was comprised of 4.67% pigment, 6.0% of Polywax 500, 0.20% of zinc dimethyldithiocarbamate (SCA-1), and 81.3% binder and comprised the organic phase in the evaporative limited coalescence process. The organic phase was then mixed with an aqueous phase prepared with 136.85 g of water, 0.918 g of potassium hydrogen phthalate (KHP), 8.80 g of Nalco™ 1060 and 1.936 g of 10% poly(adipic acid-comethylaminoethanol). This mixture was then subjected to very high shear using a Silverson L4R Mixer (sold by Silverson Machines, Inc.) followed by a Microfluidizer. Upon exiting, the solvent was removed from the particles so formed by rotary evaporator under reduced pressure. These particles were collected and washed with water. After drying the resulting particles had a volume-averaged diameter of 5.79 μm and showed irregularities on particles surface when imaged with scanning electron microscopy (SEM as shown in FIG. 1).

EXAMPLE 4

Figure 2:
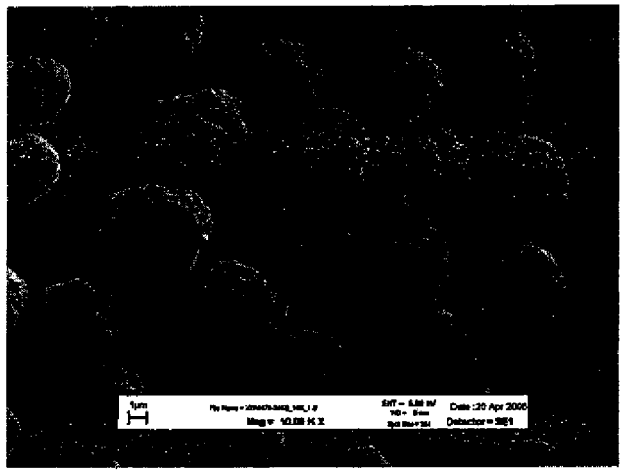
FIG. 2 is an SEM image of toner particles from Example 4.

The above procedure was repeated with the exception that 0.080 g of SCA-1 was incorporated and the reduction of Kao Binder E by 0.040 g in the organic phase. The resulting particles had a volume-averaged diameter of 5.57 μm and showed more irregular particle surface, i.e., depre troughs, as can be seen by the SEM image of FIG. 2.

EXAMPLE 5

Figure 3:
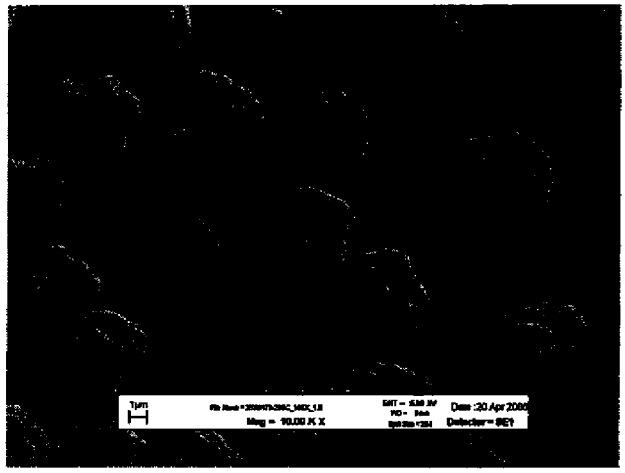
FIG. 3 is an SEM image of toner particles from Example 5.

The procedure in Example 3 was repeated with the exception that 0.200 g of SCA-1 was incorporated and the reduction of Kao Binder E by the 0.160 g in the organic phase. The resulting particles had a volume-averaged diameter of 5.96 μm and showed even more irregular shape, as shown by the SEM image in FIG. 3.

The shape of particles can be characterized by the so-called "shape factors" and by various techniques. An optical image analyzer instrument sold by Sysmex Corporation was used for shape analysis of the aforementioned toners. Table 1 lists the aspect ratio results for the three examples as calculated by the instrument software. Values close to unity mean spherical particles, while numbers smaller than one means irregular shape. The results show that the toner particles get more irregular in shape when the level of SCA-1 is increased.

EXAMPLE 6

Figure 4:
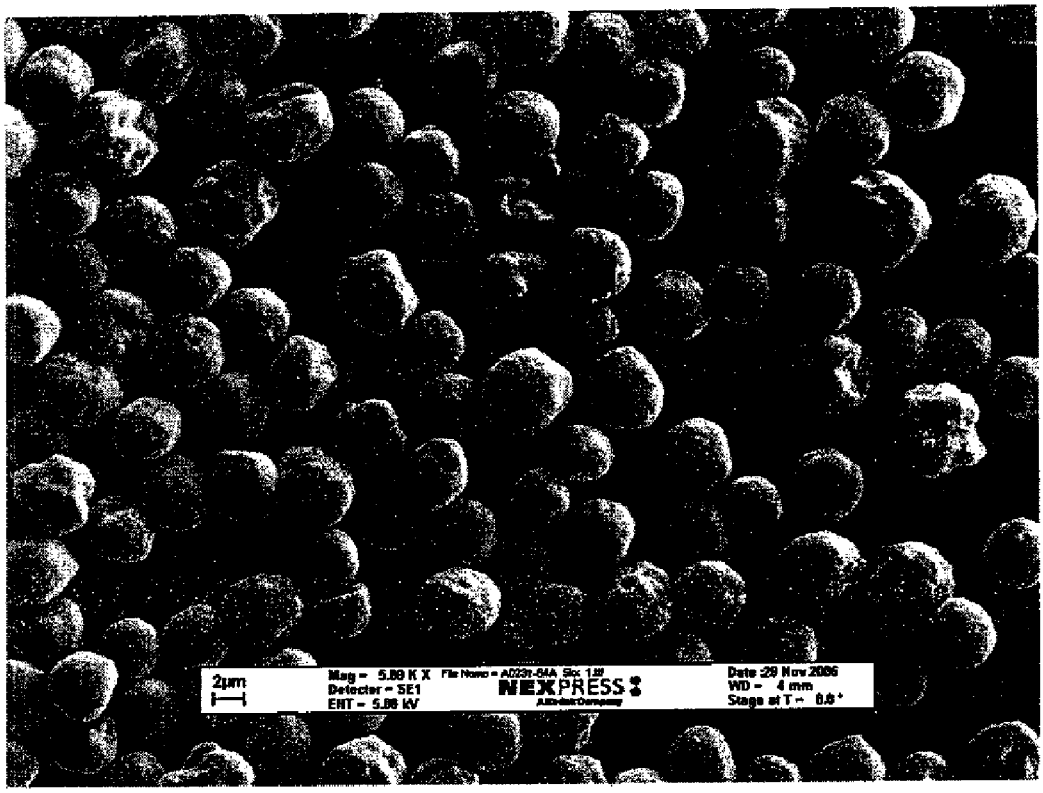
FIG. 4 is an SEM image of toner particles from Example 6.

The procedure in Example 3 was repeated with the exception that 0.200 g of SCA-2 (zinc diethyldithiocarbamate) was incorporated and the reduction of Kao Binder E by 0.160 g in the organic phase. In the SEM image of the resultant particles, FIG. 4, it can be seen that the toner has irregular shape.

TABLE 1

| | | Aspect Ratio (Min./Max.) | |
|---|---|---|---|
| Example | SCA | Mean | SD |
| 2, comparative | none | 0.917 | 0.060 |
| 3 | SCA-1 | 0.908 | 0.047 |
| 4 | SCA-1 | 0.905 | 0.051 |
| 5 | SCA-1 | 0.893 | 0.058 |
| 6 | SCA-2 | 0.897 | 0.077 |

The invention has been described in detail with particular reference to certain preferred embodiments thereof, but it will be understood that variations and modifications can be effected within the spirit and scope of the invention.

The invention claimed is:

1. A method for the preparation of electrostatographic toner comprising the steps of:

a) dissolving a polymer material in an organic solvent to form an organic phase, where the organic phase further includes a shape control agent comprising a metal complex selected from the group consisting of zinc dimethyldithiocarbamate; zinc diethyldithiocarbamate; zinc dibenzyldithiocarbamate, and zinc di-n-butyldithiocarbamate;

b) dispersing the organic phase in an aqueous phase comprising a particulate stabilizer to form a dispersion and homogenizing the resultant dispersion;

c) evaporating the organic solvent and recovering a resultant product having a shape modified by the shape control agent; and d) washing and drying the resultant product.

2. The method of claim 1 wherein a charge control agent or pigment is added in step a).

3. The method of claim 1 wherein a promoter is added in step in b).

4. The method of claim 3 wherein the promoter is selected from the group consisting of sulfonated polystyrene, alginate, carboxymethylcellulose, tetramethyl ammonium hydroxide, tetramethyl ammonium chloride, diethylaminoethyl methacrylate, water soluble complex resinous amine condensation products of ethylene oxide, urea, formaldehyde, polyethyleneimine gelatin, casein, albumin, gluten and methoxycellulose.

5. The method of claim 3 wherein the promoter is present an amount of from about 0.2 to about 0.6 parts per 100 parts, by weight, of aqueous phase.

6. The method of claim 1 wherein the solvent is selected from the group consisting of chloroform, dichloromethane, ethyl acetate, vinyl chloride, and methyl ethyl ketone.

7. The method of claim 1 wherein the amount of particulate stabilizer is between 1 to 15 parts, by weight, based on 100 parts of total solids in the toner.

8. The method of claim 1 wherein the ratio of the aqueous phase to the organic phase, by volume, ranges from 1:1 to 9:1.

9. The method of claim 1 wherein the organic phase contains charge control agents, lubricants or waxes.

10. The method of claim 1 wherein the polymer material comprises a homopolymer or copolymer selected from the group consisting of polyethylene, polypropylene, polyisobutylene, polyisopentylene, polytrifluoroolefins, polyamides, acrylic resins, ethylene-methyl acrylate copolymers, ethylene-ethyl acrylate copolymers, ethylene-ethyl methacrylate copolymers, polystyrene and copolymers of styrene with unsaturated monomers, polyesters, polyvinyl resins, ethylene-allyl alcohol copolymers, polytetrafluoroethylene, polytrifluorochloroethylene, poly(hexamethylene adipamide), poly(hexamethylene sebacamide), polycaprolactam, poly(methyl methacrylate), poly(methyl acrylate), poly(ethyl methacrylate) and poly(styrene-methyl methacrylate).

11. The method of claim 1 wherein the metal complex comprises from 0.02 to 2.0 percent of the organic phase.

12. The method of claim 1 wherein the organic phase further comprises pigments.

13. The method of claim 12 wherein the pigment is selected from the group consisting of phthalocyanines, lithols, $TiO_2$, carbon black, anthraquinone vat pigments, brominated pyranthrones and azo pigments.

14. The method of claim 12 wherein the pigments comprise an amount to give a content thereof in the toner from about 1% to 40%, by weight, based upon the weight of the resultant product.

* * * * *